US011631301B2

(12) United States Patent
Watkins

(10) Patent No.: US 11,631,301 B2
(45) Date of Patent: Apr. 18, 2023

(54) MULTIPLIER TRIGGER MECHANICAL WHEEL BONUS FEATURE

(71) Applicant: Everi Games, Inc., Austin, TX (US)

(72) Inventor: Brian Watkins, Austin, TX (US)

(73) Assignee: Everi Games, Inc., Austin, TX (US)

( * ) Notice: Subject to any disclaimer, the term of this patent is extended or adjusted under 35 U.S.C. 154(b) by 0 days.

(21) Appl. No.: 17/374,844

(22) Filed: Jul. 13, 2021

(65) Prior Publication Data

US 2023/0012875 A1 Jan. 19, 2023

(51) Int. Cl.
*G07F 17/32* (2006.01)
*G07F 17/34* (2006.01)

(52) U.S. Cl.
CPC ..... *G07F 17/3267* (2013.01); *G07F 17/3213* (2013.01); *G07F 17/34* (2013.01)

(58) Field of Classification Search
CPC ..... G07F 17/3211; G07F 17/3213; G07F 17/3223; G07F 17/3258; G07F 17/3267; G07F 17/34
See application file for complete search history.

(56) References Cited

U.S. PATENT DOCUMENTS 7,874,913 B2 * 1/2011 Webb ..... G07F 17/32 463/31
8,353,762 B2 * 1/2013 Rodgers ..... G07F 17/34 463/20
10,380,832 B2 * 8/2019 Marston ..... G07F 17/3244
2005/0075159 A1 * 4/2005 Kaminkow ..... G07F 17/32 463/16
2009/0117993 A1 * 5/2009 Bigelow, Jr. ..... G07F 17/34 463/22
2017/0228976 A1 * 8/2017 Chesworth ..... G07F 17/3262
2018/0018851 A1 * 1/2018 Devine ..... G07F 17/34
2019/0026975 A1 * 1/2019 Casey ..... G07F 17/3209
2020/0074814 A1 * 3/2020 Marks ..... G07F 17/3251

OTHER PUBLICATIONS

WMS Gaming, "Elvis™ Shake Rattling Reels™", https://youtu.be/0C309kU0DmA, Mar. 6, 2015.
Everi Games, Smokin' Hot Stuff Wicked Wheel™ Slot, https://www.youtube.com/watch?v=Pb5NO6tHVsA, released Oct. 10, 2018, wheel spin sequence beginning at 3:13 of video.

* cited by examiner

*Primary Examiner* — Justin L Myhr
(74) *Attorney, Agent, or Firm* — The Culbertson Group, P.C.; Nathan H. Calvert

(57) ABSTRACT

A wagering game, gaming machine, gaming network, and associated methods are disclosed wherein a wheel game includes dynamic paytable features associated with various trigger symbol types. Operating the gaming machine includes displaying a plurality of reels in each primary game including symbol locations which are updated with symbols to display the wager results, the reels including a plurality of wheel trigger symbols having a plurality of types each associated with a respective one of the wheel segment types. At least some wheel trigger symbols of each type including a multiplier value. A wheel spin selects a segment of a wheel. Responsive to the selected segment's type matching that of a selected wheel trigger symbol in the designated winning pattern, a wheel spin paytable is modified in a first display area applying the multiplier value of the selected wheel trigger symbol.

20 Claims, 9 Drawing Sheets

105

105

MULTIPLIER TRIGGER MECHANICAL WHEEL BONUS FEATURE

FIELD OF THE INVENTION

This invention relates to gaming systems and to gaming machines through which players may participate in wagering games, and in particular gaming machines including mechanical wheel spin features.

BACKGROUND

Many different types of gaming machines have been developed to provide various formats and graphic presentations for conducting games and presenting game results. For example, numerous mechanical reel-type gaming machines, also known as slot machines, have been developed with different reel configurations, reel symbols, and paylines. More recently, gaming machines have been developed with video monitors that are used to produce simulations of mechanical spinning reels. These video-based gaming machines may use one or more video monitors to provide a wide variety of graphic effects in addition to simulated spinning reels, and may also provide secondary/bonus games using different reel arrangements or entirely different graphics. Many video-based gaming machines have three or five spinning reels that may be stopped to display a matrix of game symbols. The symbols displayed on the stopped reels correlate to a result of the game. Video-based gaming machines may also be used to show card games or various types of competitions such as simulated horse races in which wagers may be placed.

Mechanical wheels are used with slot machines to improve the variety of prizes and game playing experiences available. A mechanical wheel is attached to a gaming machine or coupled to a group of gaming machines to provide wheel spins which can win large bonus prizes. The wheel spins are often triggered by some event at one of the gaming machines in the group.

Game manufacturers are continuously pressed to develop new game presentations, formats, and game graphics in an attempt to provide high entertainment value for players and thereby attract and keep players. What is needed are ways to provide both anticipation and excitement to players while providing more variability in game results.

SUMMARY OF THE INVENTION

The present invention includes wagering games, gaming machines, networked gaming systems, and computer programs that provide improvements to group games played on slot machines or other gaming machines. Operating the gaming machine includes displaying a plurality of reels in each primary game including symbol locations which are updated with symbols to display the wager results, the reels including a plurality of wheel trigger symbols having a plurality of types each associated with a respective one of the wheel segment types. At least some wheel trigger symbols of each type including a multiplier value. A wheel spin selects a segment of a wheel. Responsive to the selected segment's type matching that of a selected wheel trigger symbol in the designated winning pattern, a wheel spin paytable is modified in a first display area applying the multiplier value of the selected wheel trigger symbol.

According to one aspect of the invention, a method is provided for operating a gaming machine including a display system, a wager input device, a mechanical wheel, and at least one electronic controller. The method includes operating the gaming machine to receive a wager and obtain wager results for a primary game presented at the display system. A plurality of reels are updated in each primary game including symbol locations which are updated with symbols to display the wager results, the reels including a plurality of wheel trigger symbols having a plurality of types each associated with a respective one of the wheel segment types, at least some wheel trigger symbols of each type including a multiplier value. Responsive to a wager result including a designated number of wheel trigger symbols in a designated winning pattern, the method includes triggering a spin of the mechanical wheel to select a segment having a prize amount and a one of a plurality of wheel segment types each associated with a respective one of the wheel trigger symbol types. Responsive to the selected segment's type matching that of a selected wheel trigger symbol in the designated winning pattern, the method includes displaying a modification to a wheel spin paytable in a first display area of the display system applying the multiplier value of the selected wheel trigger symbol, and providing an award of the selected segment's prize amount times the selected wheel trigger symbol's multiplier value.

Another aspect of the invention is a gaming machine including a display, an audio device, a wager input device, and at least one electronic controller operatively coupled to the wager input device, the audio device and the display and configured to execute instructions related to the wagering game and to cause cash value credits to be awarded to a player in response to wagering wins. A tangible, non-transitory electronically accessible memory is connected to the at least one electronic controller and contains program code executable by the at least one electronic controller for performing the method.

Another aspect of the invention is a computer program stored on a non-transitory readable medium. The software version is, of course, typically designed to be executed by a gaming machine or networked gaming system. The software includes multiple portions of computer executable code referred to as program code. Gaming results are provided in response to a wager and displayed by display program code that generates simulated slot reels each including one or more symbol locations. The program also has game controller program code for determining game play results involving spins or other randomization of primary game presented through a first gaming mode and group gaming mode game presentations according to the method above.

Another aspect of the invention is a gaming system that includes one or more gaming servers, and a group of electronic gaming machines connected to the servers by a network, programmed to provide one of more of the methods described herein. The various functionality described herein may be distributed between the electronic gaming machines and the gaming servers in any practically functional way. For example, the current preferred architecture is for the servers to determine all aspects of game logic, random number generation, and prize awards. The gaming machines provide functionality of interfacing with the player and animating the game results to present the results received from the server in an entertaining manner. However, other embodiments of course might use a thin client architecture in which the animation is also conducted by the server and electronic gaming machines serve merely as a terminal to receive button or touchscreen input from the player and to display graphics received from the server.

Different features may be included in different versions of the invention. These and other advantages and features of the invention will be apparent from the following description of the preferred embodiments, considered along with the accompanying drawings.

DETAILED DESCRIPTION OF EXAMPLE EMBODIMENTS

Figure 1:
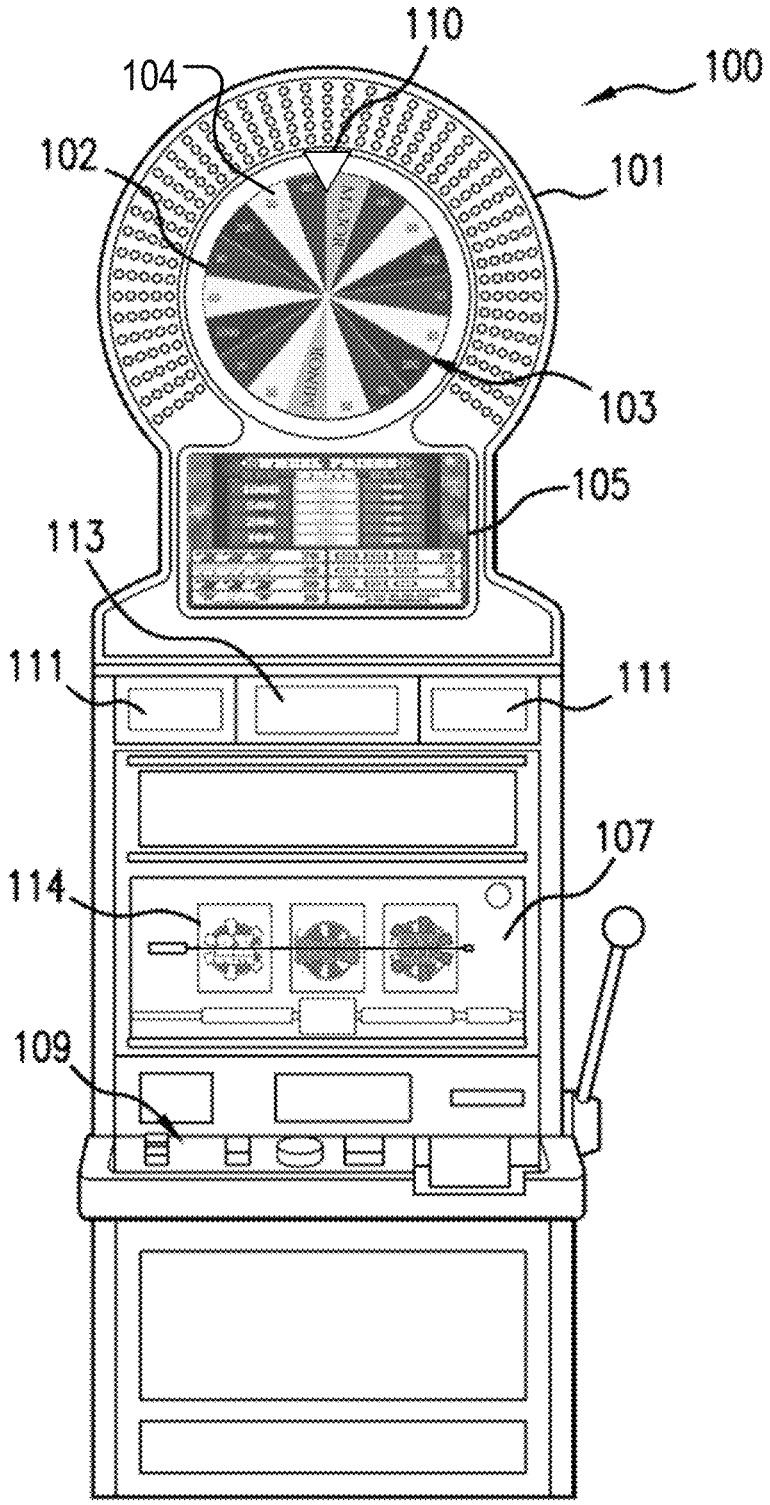
FIG. 1 is front view of an example gaming machine including a variable wheel top box in accordance with one or more embodiments of the present invention.

FIG. 1 shows an example electronic gaming machine 100 including top box 101 with a mechanical wheel or wheel display 103 ("wheel 103") and a paytable display area 105. Gaming machine 100 also includes a primary display device 107 and a user interface shown generally at reference numeral 109. In the electronic gaming machine (EGM) of FIG. 1, wheel 103 and paytable display area 105 are areas of a display device 102 and are defined by a bezel structure of top box 101. Further details of the bezel structure will be described below with particular reference to FIG. 2.

Wheel 103 is preferably a mechanical wheel mounted to the cabinet and including a selection indicator 110 and a plurality of segments 104 each having a prize amount and one of a plurality of wheel segment types. In other embodiments, wheel 103 may be presented on an electronic display. Wheel 103 is operable to spin and stop such that selection indicator 110 selects one of segments 104. The wheel segment types are each associated with a type present on wheel trigger symbols employed in the primary display, as further described below. In the example game herein, the wheel segment types are identified by the colors red, white, and blue. Primary display 107 may be instructed by a game processor to display a primary game (such as the Everi Games™ 3-Reel Mechanical American Wheel™ Game).

Figure 2:
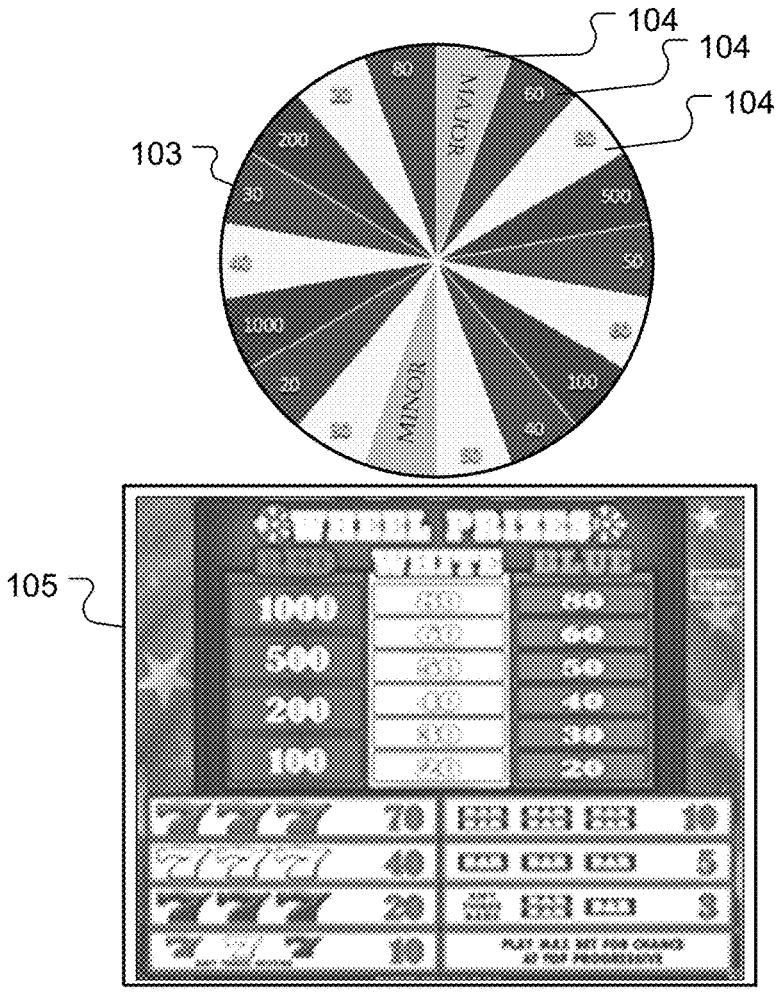
FIG. 2 is front view of an example variable wheel top box and a paytable displayed in accordance with one or more embodiments.

FIG. 2 shows in diagram form an example wheel 103 and paytable display area 105 provided in top box 101. In one or more alternative embodiments, top box 101 containing wheel 103 may be implemented as a stand-alone device, separate from any primary game and configured to accept wagers and provide one or more wheel games using a suitable player interface. When top box 101 forms a part of gaming machine 100, the wheel game displayed in wheel 103 may be triggered by one or more events, such as by the appearance of a special symbol in the primary game or by a random or pseudo-random determination of a game processor.

Figure 3:
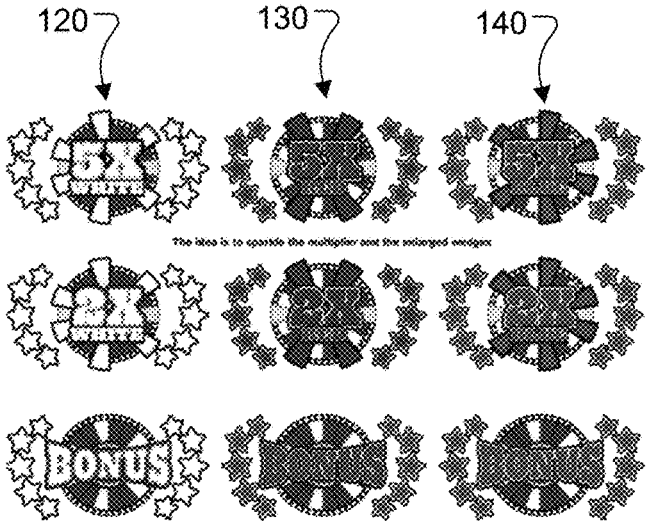
FIG. 3 shows in diagram form a number of wheel trigger symbols available in the base game according to some embodiments.

In the example of FIG. 2, wheel 103 includes a number of segments 104 which may each be presented in different colors representing the segments types that are associated with respective groups of wheel trigger symbols (FIG. 3). Two segments 104 are shown with a "Jackpot" prizes. As can be seen in paytable display area 105, three segment types are employed associated with red, white, and blue respectively. Each of these three segment types has a group of segments 104 associated therewith, with different respective prize amounts shown on the segments as listed in paytable display are 105. Two additional prize amounts (in this example, "MAJOR" and "MINOR" are also present on segments having a fourth segment type, "Jackpot," which is not associated with a wheel trigger symbol. The Jackpot type segments may be associated with a top award, such as a progressive or fixed value award. In this case, the MAJOR segment corresponds to a "Major" jackpot award such as 10,000 credits, and the MINOR segment corresponds to a "Minor" jackpot award such as 2000 credits. In some embodiments a series (or ladder) of prize tiers is used including two or more levels (or tiers) of increasing progressive or fixed value awards that may be associated with the jackpot segments and won during a wheel game. Such a series may be shown in a paytable display such as at display area 105 either simultaneously with the primary game paytable or in an alternate manner. For example, while the primary game is being played (displayed through display apparatus 107 in FIG. 1 for example), the primary game paytable may be shown in paytable display area 105, and when the wheel game is triggered, the progressive ladder may be shown in paytable display area 105 along with the depicted paytable associated with wheel segments 104. The progressive awards may have distinct color lighting associated with each level, such as ruby, emerald, sapphire, silver, gold, and platinum. Also, each progressive award may be separately displayed in the center area of the wheel in alternate fashion.

FIG. 3 shows in diagram form a number of wheel trigger symbols available in the base game according to some embodiments. Referring to FIGS. 2-3, in this embodiment, the base game reels include a plurality of wheel trigger symbols having a plurality of types each associated with a respective one of the wheel segment types, at least some wheel trigger symbols of each type including a multiplier value. Shown in FIG. 3 are three groups of wheel trigger symbols 120, 130, and 140 are shown having three different types, white (120), red (130) and blue (140). At least some wheel trigger symbols of each type including a multiplier value as shown on the notations "5×" and "2×" on the symbols. The wheel trigger symbols with the notation "BONUS" have a multiplier of 1×, or no multiplier.

In one or more alternative embodiments, a three reel mechanical primary game may be implemented with multiple paylines. In additional embodiments, the example gaming machine may be implemented with a video primary display. Additional reels may be added as well as additional visible symbols on each reel, such as by implementing 5 reels, each reel displaying 4 symbols to produce a 5×4 matrix of reel symbols.

Figure 4A:
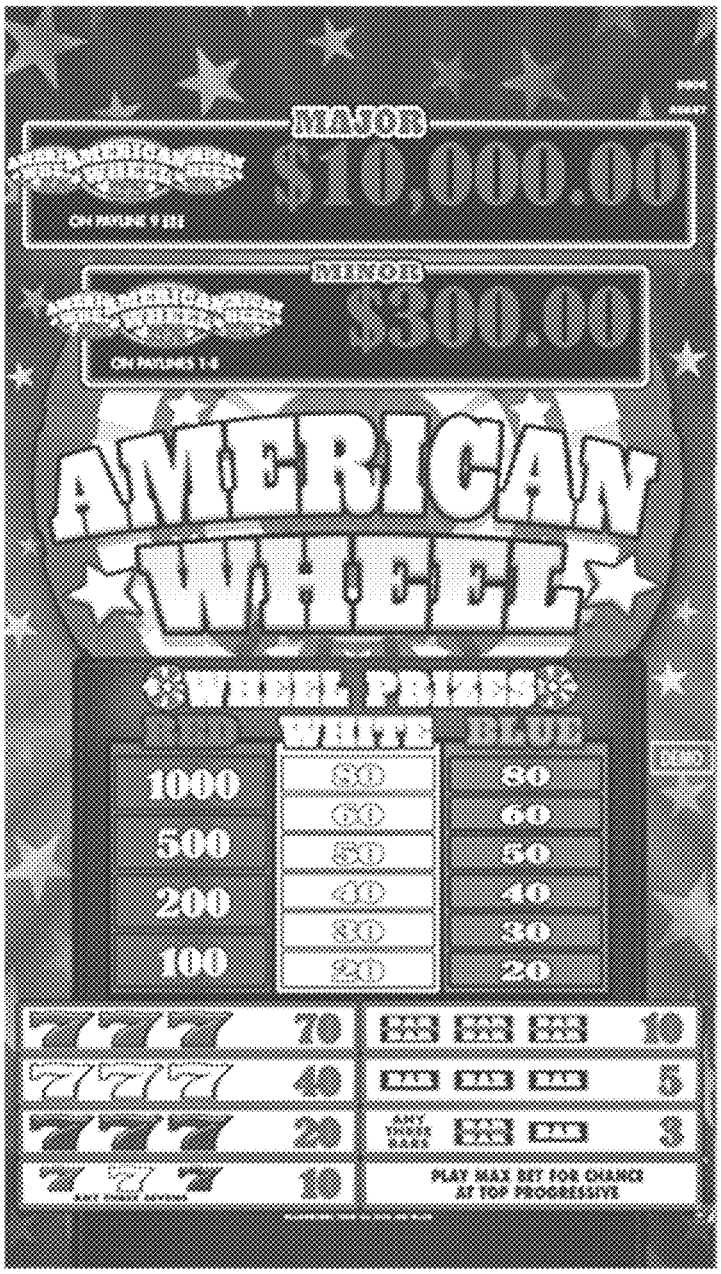
FIGS. 4A-4C are a sequence of diagrams illustrating various states of a paytable display area according to an example embodiment.
Figure 4B:
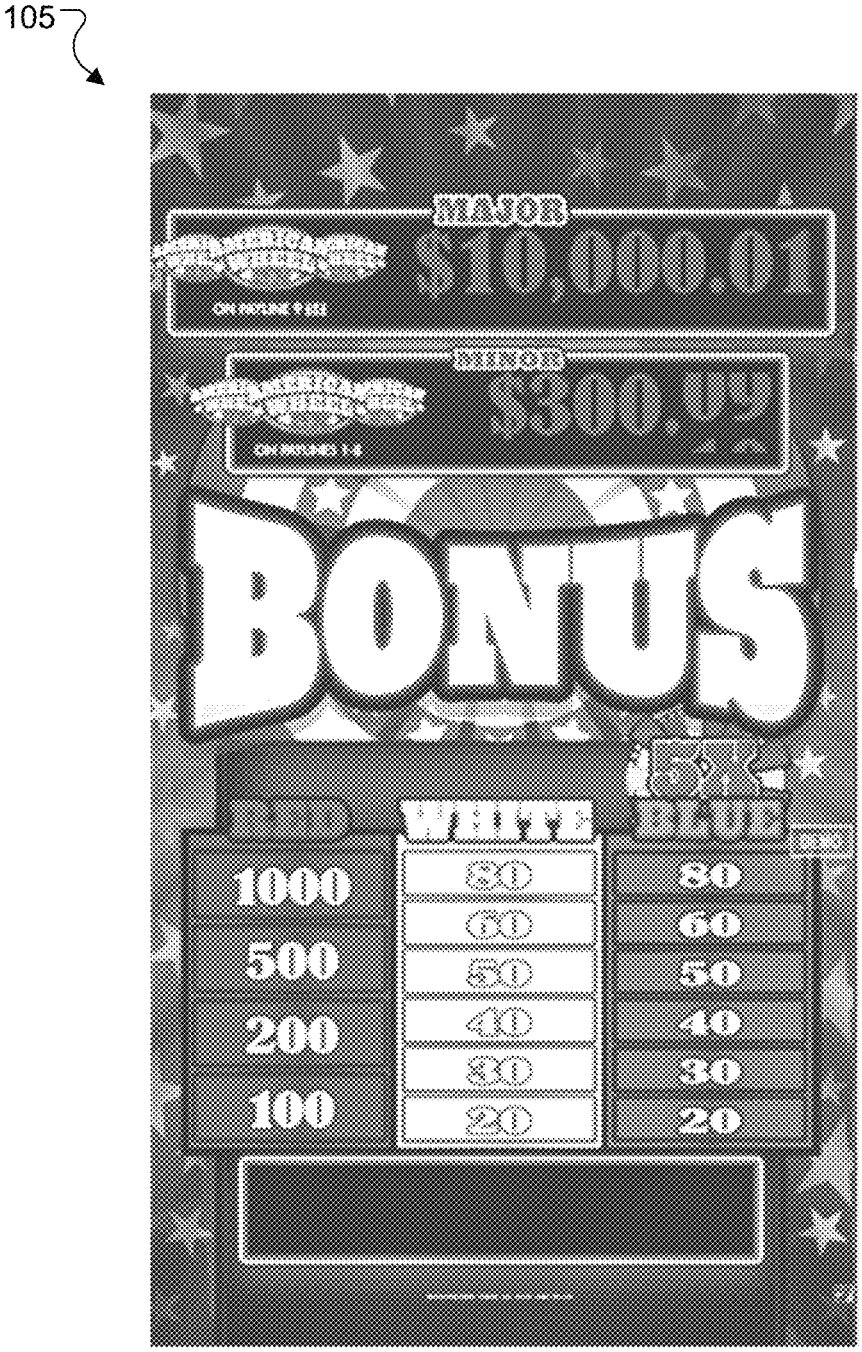
Figure 4C:
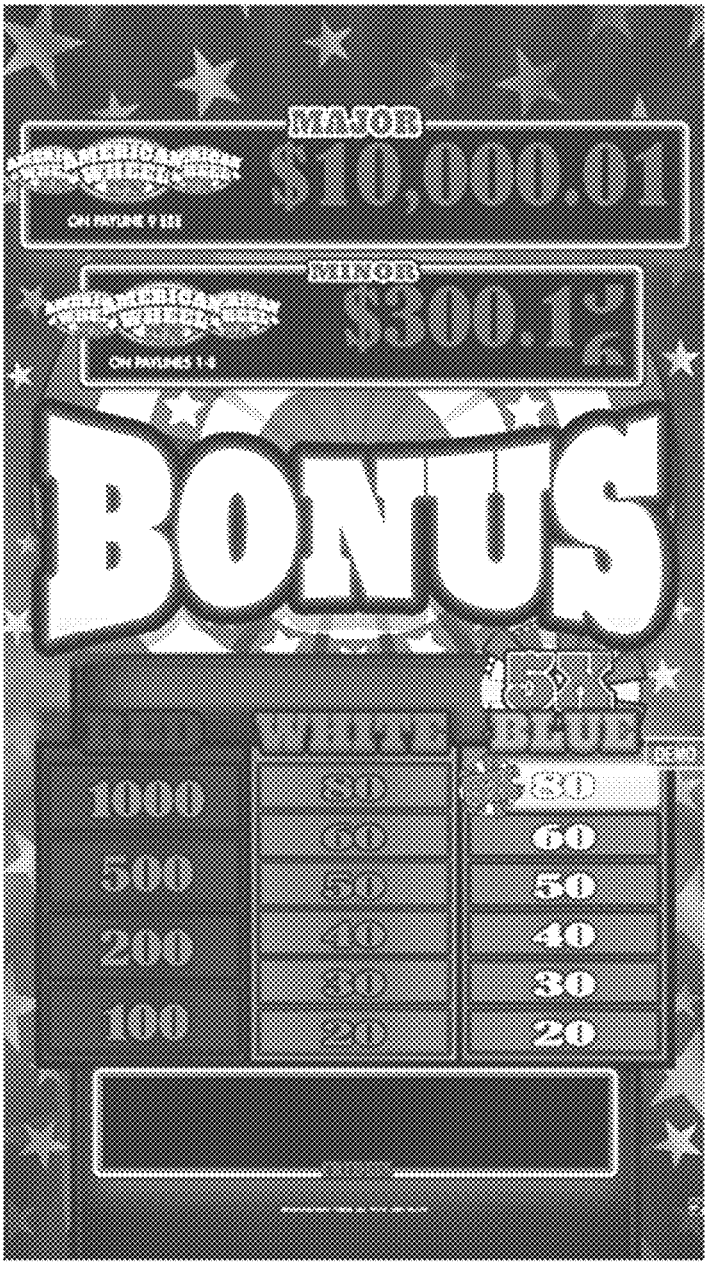

FIGS. 4A-4C are a sequence of diagrams illustrating various states of a paytable display area according to an example embodiment. The sequence is further described below with respect to the process of FIG. 5.

Figure 5:
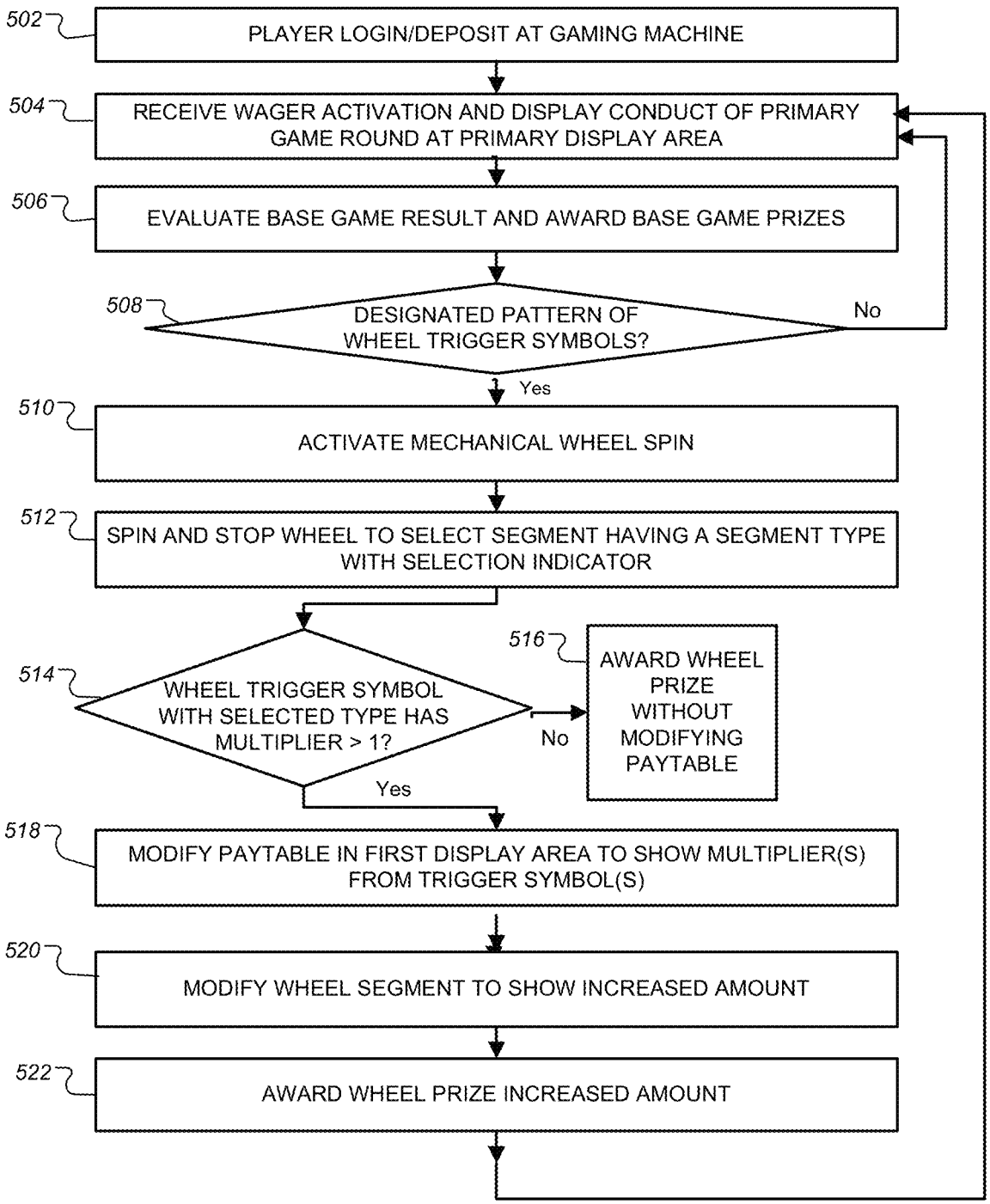
FIG. 5 is a flowchart of a process for operating a gaming machine according to some embodiments.

FIG. 5 is a flowchart showing a process for operating a gaming machine to provide a wagering game according to one or more embodiments of the invention. Generally, the process is conducted under control of one or more electronic processors to provide gaming results on one or more displays on a gaming machine such as those described herein. To initialize the game and make it available for wagering, the process starts a game engine software package for executing game code like that depicted in FIG. 5, including loading data structures such as media assets and code for a first gaming mode and a second group gaming mode. The process of operating a gaming machine for a player starts at block 502 where a player logs in or deposits money or a credit voucher at a gaming machine. This typically includes receiving the player deposit through a credit input device such as the bill/voucher acceptor 112 (FIG. 7), and in response activating a credit meter value that establishes a player credit balance.

At block 504, the process receives a wager activation and obtain wager results for a primary game presented at the display system. In this embodiment, the conduct of the base game is displayed by displaying a plurality of reels in each primary game including symbol locations which are updated with symbols to display the wager results. The reels include a plurality of wheel trigger symbols having a plurality of types each associated with a respective one of the wheel segment types, at least some wheel trigger symbols of each type including a multiplier value. The results of the base game are evaluated and base game prizes awarded at block 506. For results in which no wheel spin trigger pattern is produced, paytable display are 105 preferably displays an unmodified state such as that shown in FIG. 4A, which is also shown during blocks 502 and 504.

At block 508, the process checks if the wager result includes a designated number of wheel trigger symbols in a designated winning pattern. If so, the process goes to block 510 where it triggers a spin of the mechanical wheel to select a segment with a segment. If not, the process conducts any other bonus features resulting from the base game, and returns to block 504 to receive another wager activation. In the three-reel embodiment shown in FIG. 1, the designated number of wheel trigger symbols is three, one on each reel. The designated winning pattern is a wheel trigger symbol in each reel at any location in a payline that is active. For example, a horizontal payline across the middle three symbols of the array with one wheel trigger symbol on each reel is employed in the embodiment of FIG. 1. Other designated winning patterns may also be checked to see if they contain the designated number of wheel trigger symbols. In a preferred embodiment, a 3×3 matrix of symbol locations is employed, in which 9 three-symbol paylines are available to be wagered on by the player. A designated winning pattern for a wheel spin is formed by three wheel trigger symbols being produced on any payline which is activated by being wagered on.

When a designated pattern is detected at block 508, the process updates paytable display area 105 to a state like that shown in FIG. 4B, including any multipliers in the pattern associated with each type of wheel trigger symbols. For example, in FIG. 4B, a designated winning pattern is produced including a red BONUS symbol (no multiplier), a white BONUS symbol (no multiplier), and a blue 5X symbol. To communicate to the player that wheel awards of the designated type (blue) will be multiplied if they are achieved by the wheel spin, paytable display area 105 includes a graphic designator added to the paytable and associated with the blue column.

The wheel spin activated at block 510 includes spinning and stopping the mechanical wheel to select a segment with the selection indicator, as shown at block 512. The segment has a segment type as discussed above. As shown at block 514, responsive to the selected segment's type matching that of a selected wheel trigger symbol in the designated winning pattern, the process at block 518 displays a modification to a wheel spin paytable in paytable display area 105 of the display system applying the multiplier value of the selected wheel trigger symbol. An example of such a modification is shown by the state of paytable display area 105 in FIG. 3C, depicting a 5× multiplier applied to a blue type award segment's award of "80" credits which has been selected by the wheel in an example scenario. Such a modification is performed for each wheel trigger symbol in the designated pattern that includes a multiplier. If at block 514 the selected segment's type matches that of a wheel trigger symbol in the designated winning pattern without a multiplier greater than 1 (for example, the red, white, or blue BONUS symbols of FIG. 3), the process goes to block 516 where it awards the prize displayed on the wheel without any further state change or modification to paytable display are 105 or the wheel segment.

For wheels that include active displays on the wheel itself, the display are of the wheel segment may also be modified at block 520 to show an increased prize amount. Such a modification may also be performed before the wheel spin at block 510 to display on the wheel segments all potential prize amounts that have been increased by multipliers.

Then at block 522 the process provides an award of the selected segment's prize amount times the selected wheel trigger symbol's multiplier value. A graphic sequence is then shown of the total award, 80×5 credits, being awarded and displayed in the area labeled "CREDITS" toward the bottom of paytable display area 105.

A wheel game using wheel top box 101 may be initiated by a processor or by a processor in combination with a player touching a "PLAY" button or touching (or sliding a finger or hand along) a touch sensitive primary game display 107 in FIG. 1. Alternative arrangements within the scope of the present invention may facilitate player interaction through displays included in top box 101 itself. For example, the display visible through wheel 103 may comprise a touch panel display enabling an interaction of the player with the wheel by the player touching (or sliding a finger or hand along) a portion of wheel image in the display area of wheel 103.

The wheel feature game may require a wager in addition to wagers on one or more paylines or may require a maximum permissible bet. When not betting a sufficient amount to activate the wheel spin feature, the bonus trigger on an active payline may pay a flat credit value without spinning the wheel.

Figure 6:
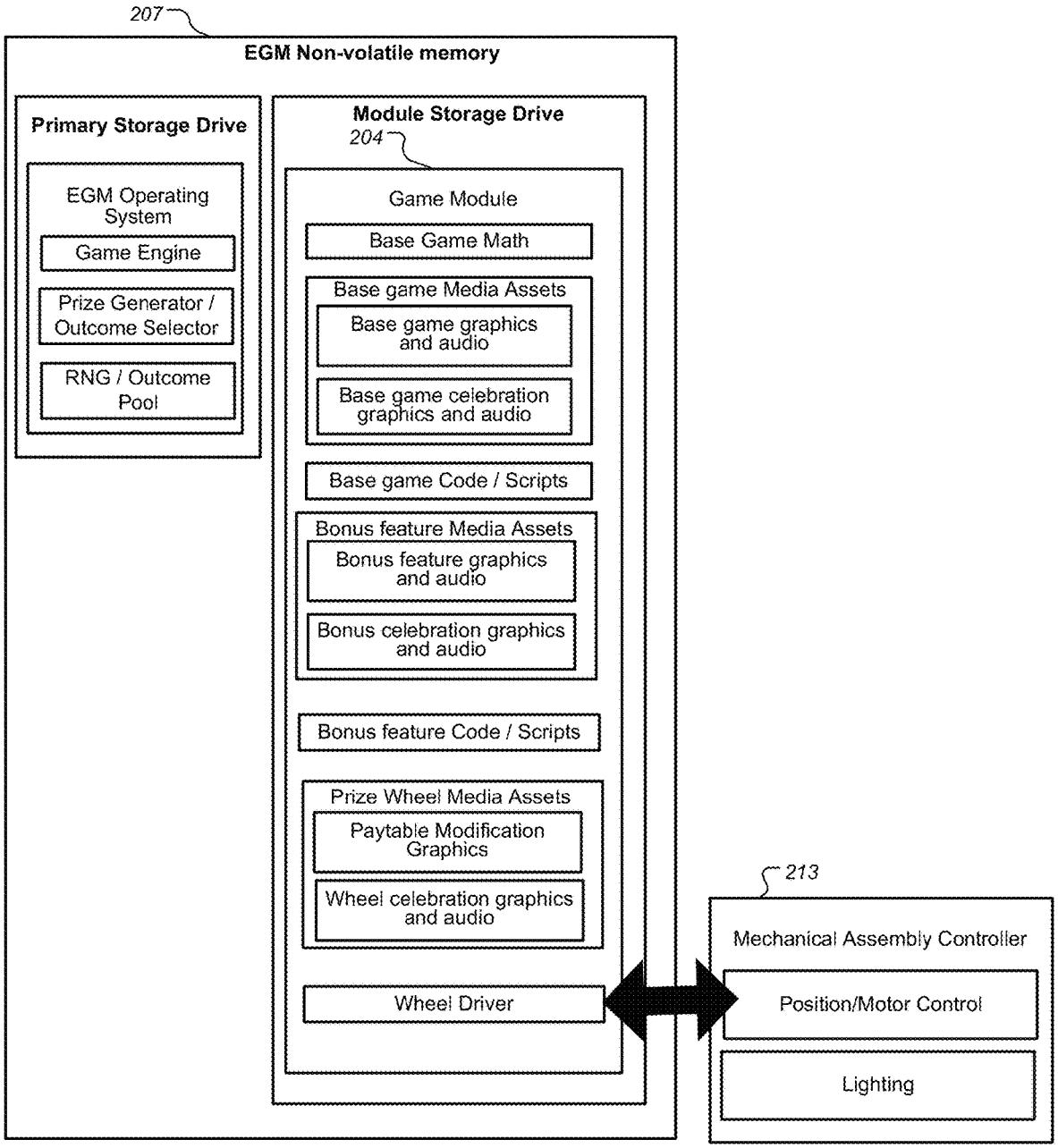
FIG. 6 illustrates in block diagram form a software and data structure design for a gaming machine according to some embodiments.

FIG. 6 illustrates in block diagram form a software and data structure design for an EGM according to some embodiments. A EGM non-volatile memory system 207 includes a primary storage drive and a module storage drive.

Figure 8:
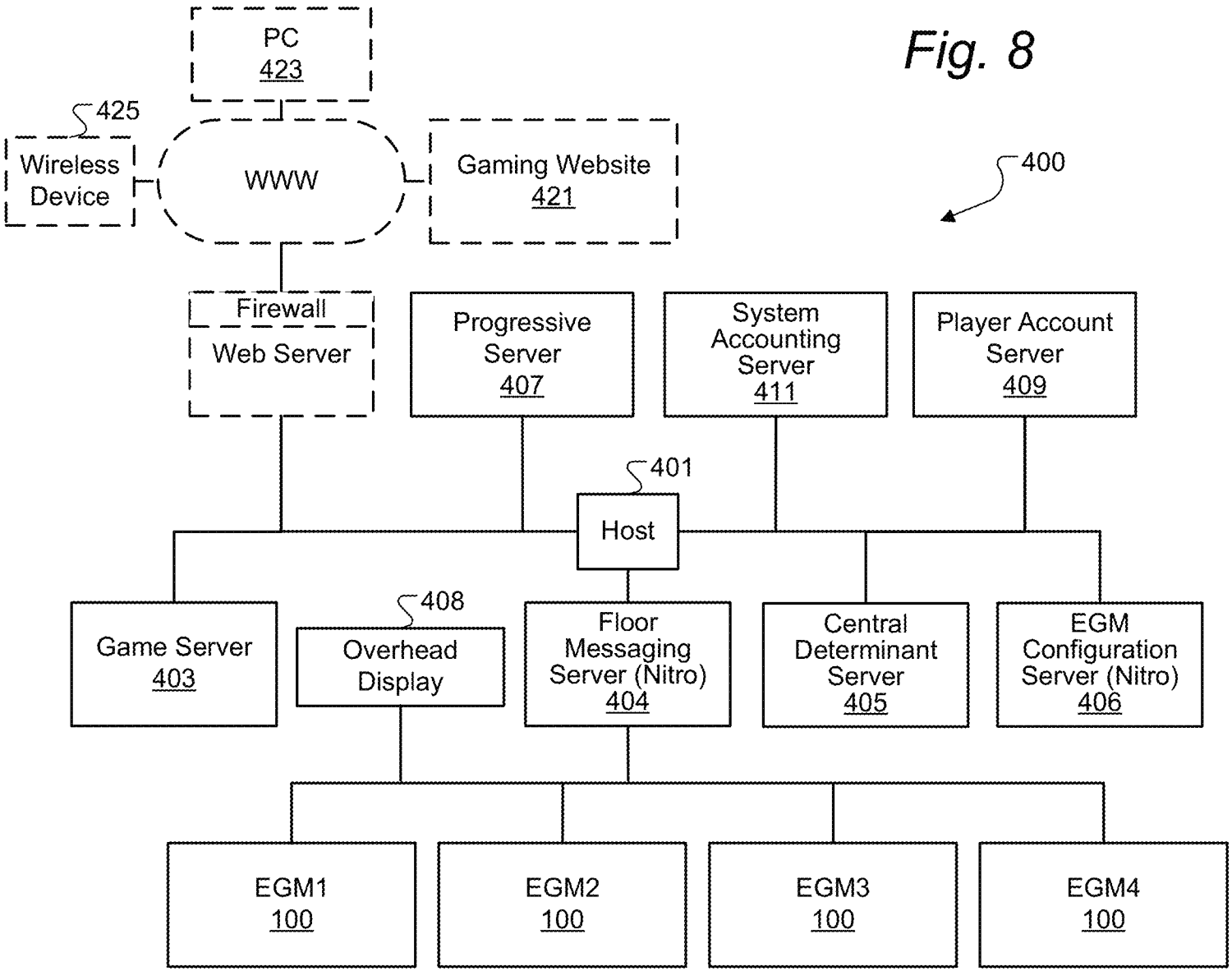
FIG. 8 is a system block diagram of a gaming system according to one embodiment of the present invention.

The primary storage drive holds the EGM operating system and a game engine and may include a prize generator for providing randomized game outcomes, either with a local prize generator/outcome selector as shown, or by a software module making a request to a gaming outcome server such as central determinant server 405 (FIG. 8). In some embodiments, a random number generator (RNG) such as a hardware-based RNG or a software RNG algorithm is used to produce or select randomly generated outcomes. Outcomes may be selected from an outcome pool including randomly generated outcomes, held locally or on a central determinant server. In this embodiment, the game engine is the Nitro™ game engine provided by Everi Games, Inc., which interacts with a Nitro game server for installing new games, updating games, and managing installed games.

A gaming module storage drive, in this embodiment the Nitro Content drive, holds the software and data structures for providing particular games, embodied in a game module 204. As shown in the drawing, game module 204 is stored in a separate module storage drive than the drive which stores EGM game engine. This separated storage arrangement allows a configuration server to access the module storage drive for configuring the gaming machine.

Game module 204 includes at least first data describing game math for describing the mathematical response to random numbers or randomly generated prizes provided by the prize generator. The base or primary game math data in module 204 includes including bonus wager data and bonus payout data and definitions of the mathematical probabilities or operations to produce bonus game results based upon random numbers generated for game results. Game module 204 also base game code or scripts for executing the logic and rules of the primary game. The base game logic is preferably executed by script code executed by a script engine portion of the game engine, but may in other embodiments be another type of program code such as executable code executed directly by the EGM processor. Game module 204 also includes base game media assets with digital media data including graphics and audio for all media features and sequences to be employed for executing the primary game results and any related media presentations such as the depicted bonus celebration graphics and audio.

Depicted below the base game code are bonus feature code and bonus feature media assets and bonus feature code for executing bonus features such as the wheel spin feature described herein. Bonus features graphics and audio media are included and along with celebration graphics and audio for presenting bonus awards. A wheel driver is included to control the position of the mechanical wheel and related lighting.

Referring to FIG. 5 and FIG. 6, the process functionality is controlled by the system processor by executing program code, executable by a gaming machine or gaming network processor, to accomplish the functionality as described herein. It should be understood that this is only one example embodiment, and other versions may divide the processing tasks of the game method in a different manner. For example, some systems may employ a thin client architecture in which practically all of the processing tasks are performed at the game server, and only display information for the player interface transmitted to the electronic gaming machine. In such an embodiment, only the steps involving player input or display are performed by the electronic gaming machine, with the remaining steps performed by one of the game servers in the system. In such a case, though, the software architecture is preferably designed as a thin client in which a dedicated virtual machine running on the game server (or a virtual machine server connected in the gaming network) performs the tasks designated in the present drawing as occurring at the gaming machine. To perform the gaming machine operating process of FIG. 5, the thin client version of the process performed at the game server further includes receiving game play requests originating from electronic gaming machine, and sending commands to the gaming machine to show reels spinning, the graphical accumulation object, the wheel spin control process, and results being displayed. The division of game logic steps between gaming machines and servers is known in the art and may be accomplished according to suitable methods allowed for the relevant gaming jurisdictions.

The gaming machine 100 shown in FIG. 1 includes middle display 113 which may display a server-based game (such as bingo, in the case of a Class II gaming machine), advertising or other content as may be provided over a network or through the gaming machine. User interface 109 provides various controls to allow a patron to place wagers and initiate play of one or more games at gaming machine 100. User interface 109 may include a commercially available player tracking interface unit, such as a Bally iView™ unit, a button deck with buttons for selecting paylines, wagers per payline, and additional wagers associated with the wheel game or eligibility thereto, and a "Play" button and/or handle with which the player may initiate play of the primary game. The button deck may be provided on a touch panel in addition to or in the alternative to a physical button deck. The Play button may be also useable to initiate spinning of the wheel shown in the wheel 103 when the wheel game is triggered. The player tracking unit may include a card reader, a bill acceptor/printer, and player display graphic which may include a greeting to the player, player points, a menu for communicating with a player tracking server, and other casino operator content.

While gaming machine 100 is shown as an upright gaming machine cabinet style, various cabinet styles or device types may be utilized including a slant top cabinet style, a bar top cabinet style (where the cabinet may be part of a bar/table top and/or housed therein), a personal computer or handheld device. For example, in cases where only a single display is available for use with a device, a user interface, primary display, and paytable may be predominantly displayed to initiate and during primary game play. When a triggering event occurs, the display content may change (or be transformed) to display the wheel and any associated paytable or related content, such as available progressive awards and number of wheel spins remaining.

Each reel 114 shown in FIG. 1 includes a series of symbols viewable in display 107 (for example, through a glass window or transparent display, in the case of mechanical reels, or, as displayed in a video format). With the reels 114 in a stationary position, the symbols visible in display device 107 may be viewed as an array of symbols. During a wagering game (as may be initiated by a player by placing a wager and pressing a Play button), the reels may be simulated to spin (or electro-mechanically spun in the case of mechanical reels) about an axle under the control of a game processor which randomly or pseudo-randomly determines the game outcome and causes the reels to stop in accordance with the determined game outcome.

One or more paylines, combinations, or patterns of the symbols including those visible in display device 107 may be correlated to a game result payable in accordance with a paytable such as may be displayed in paytable display area 105. For example, a game with five reels and displaying four symbol locations per reel may have four paylines which extend horizontally across each reel and many others which may extend diagonally or in a jagged line across the various reel symbol locations both on and off the viewable display area. A patron may wager on one or more of the paylines during each game play. Display device 107 may thereby be used to display game results to one or more patrons who may view gaming machine 100 and the game processor may make payment to the patron by incrementing a credit meter for winning outcomes of paylines in accordance with the paytable and upon which the patron has wagered.

In one or more alternative embodiments, gaming machine 100 may a mechanical reel assembly having multiple reels with fixed or dynamic symbols as a primary display device 107. Conventionally, mechanical reels include reel strips with fixed symbols. However, reel strips may be, for example, implemented using FOLED (flexible organic LED) or comparable reel strips wherein one or more symbols may be programmed dynamically to vary the symbol and/or its appearance, either from one fixed image to another (such as changing a symbol to a wild symbol or changing a series of symbols to wild symbols), or, from a fixed image to a dynamic (e.g. animated or video) image or a set of miniature video reels. In various instances when a symbol changes to another symbol, a bonus or enhanced award may be paid in accordance with the paytable or a multiple thereof or may be a bonus (a fixed or progressive amount) paid separate from the paytable. In the event that the payment is a progressive, a progressive pool may be generated from an operator's marketing dollars or from play at one or more gaming machines which may be eligible for the progressive award.

Primary display device 107 may comprise a single display or may comprise two or more displays (e.g. two displays in over- or under-laying relation to each other). For example, primary display device 107 may comprise a touch-sensitive display panel, such as a flat panel LCD or LED display, which may be programmed to display an opaque or thematic frame image (which may include video and/or still images) except over a reel display area. Primary display 107 may be programmed to be transparent or translucent during game play of the primary wagering game, so that the patron may view the game presentation in the reel display area where a set of mechanical reels may be viewable or a set of video reels may be displayed by an underlying display. In addition, the entire display surface of primary display device 107 (or a portion thereof) may be configured to respond to the patron's touch such as to select paylines, select credits wagered per payline, and/or play the primary game (or wheel game if triggered or activated).

In the case of Class II gaming devices, the overall structure of the various devices as discussed above is essentially the same with the major difference being the method of determining the game outcome. Commonly, Class II gaming devices utilize the game of bingo as the basis for determining a winning outcome where the ball draw is performed remotely by a network or central determination server (alternative games may be used for determining game outcomes, such as through a lottery drawing of a finite set of numbers, if permitted by the licensing jurisdiction). Class II gaming systems are commonly referred to as central determination systems wherein pools and sub-pools of game outcomes are determined by a central server (or gaming device) and distributed amongst a set of networked gaming devices. The distribution step may be on demand, such as when a gaming device receives a game request, or sets of game outcomes may be distributed to the various networked gaming devices in which case the game processor of the requesting gaming device may select a game outcome from the set of game outcomes, such as by using an RNG or other selection process.

Figure 7:
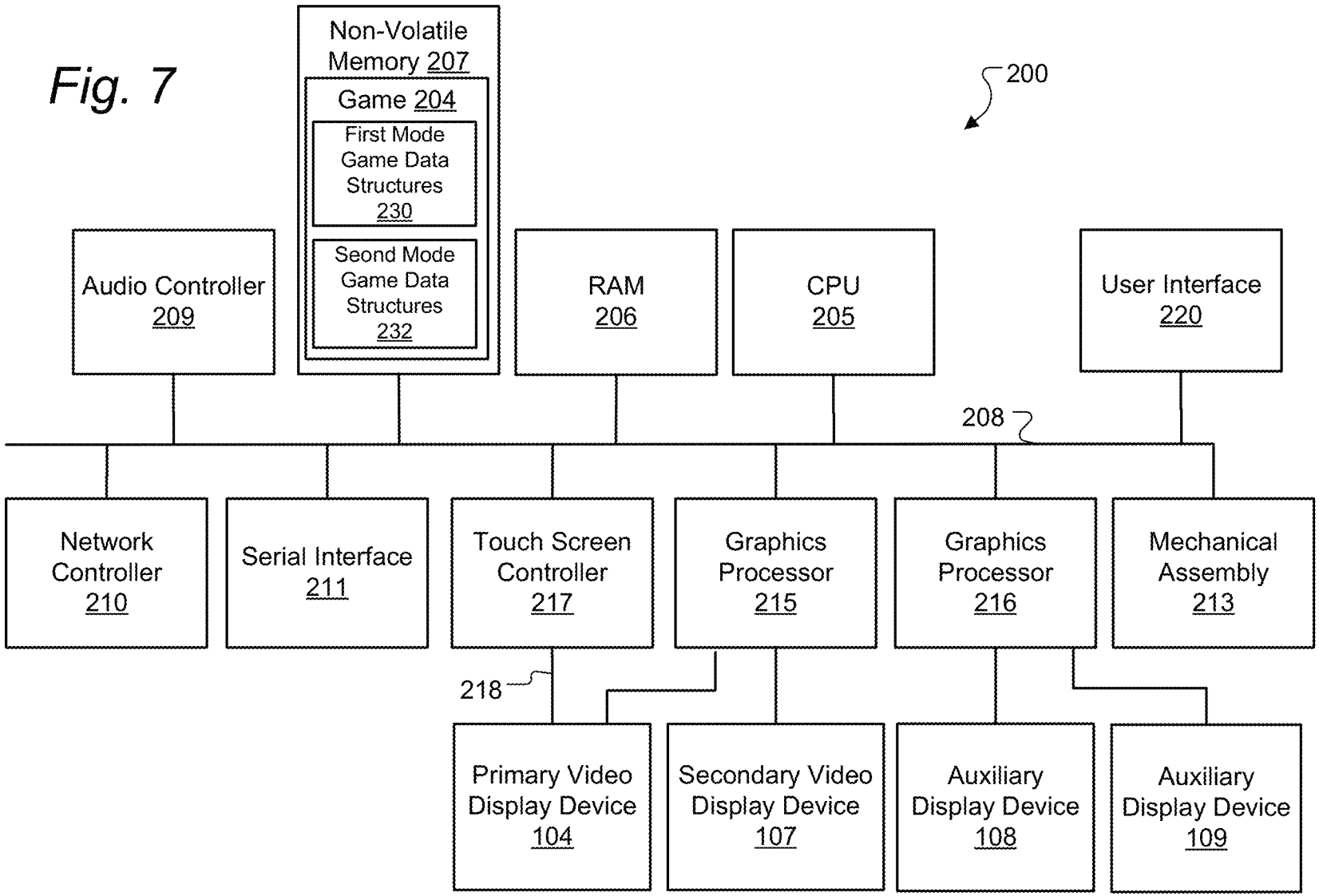
FIG. 7 is a block diagram showing various electronic components of the gaming machine shown in FIG. 1 together with additional gaming system components.

FIG. 7 shows a logical and hardware block diagram 200 of gaming machine 100 which includes a central processing unit (CPU) 205 along with random access memory 206 and nonvolatile memory or storage system 207. All of these devices are connected on a system bus 208 with an audio controller 209, a network controller 210, and a serial interface 211. A graphics processor 215 is also connected on system bus 208 and is connected to drive primary display 107 and secondary display for paytable display area 105. A second graphics processor 216 is also connected on system bus 208 in this example to drive the auxiliary display device for middle display 113. Gaming machine 100 also includes a touch screen controller 217 connected to system bus 208. Touch screen controller 217 is also connected via signal path 218 to receive signals from a touchscreen element associated with primary video display device 107. It will be appreciated that the touchscreen element itself typically comprises a thin film that is secured over the display surface of primary video display device 107. The touchscreen element itself is not illustrated or referenced separately in the figures.

All of the elements 205, 206, 207, 208, 209, 210, and 211 shown in FIG. 7 are known elements used in the gaming machine industry. These elements are preferably mounted in a chassis which is housed in the gaming machine cabinet shown in FIG. 1. Alternatively, the various electronic components may be mounted on one or more circuit boards or modules housed within the cabinet of the gaming machine without a separate enclosure. Those familiar with data processing systems and the various data processing elements shown in FIG. 7 will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a IEEE 1394 controller for example. It will also be appreciated that some of the devices shown in FIG. 7 as being connected directly on system bus 208 may in fact communicate with the other system components through a suitable expansion bus. Audio controller 209, for example, may be connected to the system via a PCI bus. System bus 208 is shown in FIG. 7 merely to indicate that the various components are connected in some fashion for communication with CPU 205 and is not intended to limit the invention to any particular bus architecture. Numerous other variations in the gaming machine internal structure and system may be used without departing from the principles of the present invention.

Although separate graphics processors are shown in this embodiment, it will be appreciated that CPU 205 may control all of the display devices directly without any intermediate graphics processor. The invention is not limited to any particular arrangement of processing devices for controlling the video display device included with gaming machine 100.

In the illustrated gaming machine 200, CPU 205 executes software which ultimately controls the entire gaming machine including the receipt of player inputs and the presentation of the graphic symbols displayed according to the invention through the various display devices associated with the gaming machine, which may include a mechanical reel display and/or a mechanical wheel in some embodiments. CPU 205 also executes software related to communications handled through network controller 210, and software related to various peripheral devices such as those connected to the system through audio controller 209, serial interface 211, and touch screen controller 217. CPU 205 may also execute software to perform accounting functions associated with game play. Random access memory 206 provides memory for use by CPU 205 in executing its various software programs, while the nonvolatile memory or storage system 207 may comprise a hard drive or other mass storage device providing storage for programs not in use or for other data generated or used in the course of gaming machine operation. Network controller 210 provides an interface to other components of a gaming system in which gaming machine 100 is included.

Still referring to the hardware and logical block diagram 200 showing an example design for a gaming machine 100, the depicted machine in operation is controlled generally by CPU 205 which stores operating programs and data in memory 207 with game module 204, and software or drivers for user interface 220, network controller 210, audio/visual controllers, along with a controller 213 for a mechanical wheel assembly (if a mechanical configuration is used) and a mechanical reel assembly. The game module 204, once installed, also is held in non-volatile memory of the EGM, preferably a separate flash drive or hard drive from the memory holding the EGM operating system. CPU or game processor 205 may comprise a conventional microprocessor, such as an Intel microprocessor, mounted on a printed circuit board with supporting ports, drivers, memory, software, and firmware to communicate with and control gaming machine operations, such as through the execution of coding stored in memory 207 including one or primary game modules 204, including executable code and data structures such data structures for performing the primary game in the mode 230, and data structures for performing the primary game in the second, group gaming mode 232. Game processor 205 connects to user interface 220 such that a player may enter input information, and game processor 205 may respond according to its programming, such as to apply a wager and initiate execution of a game.

Game processor 205 also may connect through network controller 210 to a gaming network, such as example casino server network 400 shown in FIG. 8.

Referring to FIG. 7, a block diagram of an example casino server network system 400 associated with one or more gaming facilities is shown, including one or more networked gaming machines 100 in accordance with one or more embodiments. While some of the servers have been shown separately, they may be combined or split into additional servers having additional capabilities. The casino server network system 400 may be implemented over one or more site locations and include host server 401, and an EGM configuration server 406 (in the preferred version the Even Games Nitro Host server) for managing the configuration of multiple EGMs 100 on the network. A group overhead display device 408 is coupled to network 400 may include its own controller and graphics processor for driving the group display in response to commands received over a network connection. The network may also include remote game play server 403 (which may be configured to provide game processor functionality including determining game outcomes and providing audio/visual instructions to a remote gaming device), a floor messaging server 404, central determinant server 405 (which may be configured to determine lottery, bingo, or other centrally determined game outcomes and provide the information to networked gaming machines 100 providing lottery and bingo-based wagering games to patrons), progressive server 407 (which may be configured to accumulate a progressive pool from a portion of wagering proceeds or operator marketing funds and to award progressive awards upon the occurrence of a progressive award winning event to one or more networked gaming machines 100), player account server 409 (which may be configured to collect and store player information and/or awards and to provide player information to gaming machines 100 after receiving player identification information such as from a player card), and accounting server 411 (which may be configured to receive and store data from networked gaming machines 100 and to use the data to provide reports and analyses to an operator). Through its network connection, gaming machine 100 may be monitored by an operator through one or more servers such as to assure proper operation, and, data and information may be shared between gaming machine 100 and respective of the servers in the network such as to accumulate or provide player promotional value, to provide server-based games, or to pay server-based awards.

As shown, networked gaming machines 100 (EGM1-EGM4) and one or more overhead group displays 408 may be network connected and enable the content of one or more displays of gaming machines 100 to be mirrored or replayed on an overhead display. EGMs 100 may also feed celebration graphics directly to the overhead displays 408 in the course of providing games, for example to show a celebration for a large bonus win on a particular EGM 100. Typically the overhead display function and group celebration scenarios are managed by a floor messaging server such as Nitro floor messaging server 404, which receives messages from EGM's 100 to communicate group gaming mode wins, bonus game wins, or awards of other large prizes such as progressive prizes. The primary display content may also be stored by the display controller or game processor 205 and transmitted through network controller 210 to the overhead display controller either substantially simultaneously or at a subsequent time according to either periodic programming executed by game processor 205 or a triggering event, such as a jackpot or large win, at a respective gaming machine 100.

In one or more embodiments, game server 403 may provide server-based games and/or game services to network connected gaming devices, such as gaming machines 100 (which may be connected by network cable or wirelessly). Progressive server 407 may accumulate progressive awards by receiving defined amounts (such as a percentage of the wagers from eligible gaming devices or by receiving funding from marketing or casino funds) and provide progressive awards to winning gaming devices upon a progressive event, such as a progressive jackpot game outcome or other triggering event such as a random or pseudo-random win determination at a networked gaming device or server (such as to provide a large potential award to players playing the community feature game). Progressive prizes may be made available to be won through display on the group gaming board in group gaming mode, as they are in base gaming mode. Accounting server 411 may receive gaming data from each of the networked gaming devices, perform audit functions, and provide data for analysis programs, such as the IGT Mariposa program bundle.

Player account server 409 may maintain player account records, and store persistent player data such as accumulated player points and/or player preferences (e. g. game personalizing selections or options). For example, the player tracking display may be programmed to display a player menu that may include a choice of personalized gaming selections that may be applied to a gaming machine 100 being played by the player.

In one or more embodiments, the player menu may be programmed to display after a player inserts a player card into the card reader. When the card reader is inserted, an identification may be read from the card and transmitted to player account server 409. Player account server 409 transmits player information through network controller 210 to user interface 220 for display on the player tracking display. The player tracking display may provide a personalized welcome to the player, the player's current player points, and any additional personalized data.

In one or more embodiments, a gaming website may be accessible by players, e. g. gaming website 421, whereon one or more games may be displayed as described herein and played by a player such as through the use of personal computer 423 or handheld wireless device 425 (e.g. Apple iPhone, Android phone, tablet, phablet, virtual reality device, iPad, etc.). To enter the website, a player may log in with a username (that may be associated with the player's account information stored on player account server 409 or be accessible by a casino operator to obtain player data and provide promotional offers), play various games on the website, make various personalizing selections and save the information, so that during a next gaming session at a casino establishment, the player's playing data and personalized information may be associated with the player's account and accessible at the player's selected gaming machine 100.

In the case of a Class III gaming devices, when a game is initiated, a random number generator (RNG) may be operated by game processor 301 to determine the game outcome (either directly or by randomly selecting reel stop positions and evaluating those positions to identify an outcome). Commonly, game processor 301 is positioned within gaming machine 100 and configured to manage the operation of the gaming machine components, such as shown in FIG. 3. However, the game processor may be either onboard or external to a gaming device played by a player, such as an electronic tablet (e.g. Apple iPad® or gaming specific tablet), personal data assistant (PDA), cellular telephone (e.g. Blackberry® or Apple iPhone®), surface table (e.g. Microsoft®/IGT® touch sensitive gaming surface table), etc. In such case, when the player places a wager and initiates play of the game through user interface 305 of the gaming device, the game processor may be onboard the device or remotely located, such as within a network gaming server. In the latter case, an onboard microprocessor, controller, or digital signal processor may execute coding to transmit the wager and game request information through the network, and the remote game processor may operate an RNG to determine the game outcome.

Referring generally to the description herein, any use of ordinal terms such as "first," "second," "third," etc., to refer to an element does not by itself connote any priority, precedence, or order of one element over another, or the temporal order in which acts of a method are performed. Rather, unless specifically stated otherwise, such ordinal terms are used merely as labels to distinguish one element having a certain name from another element having a same name (but for use of the ordinal term).

Further, as described herein, the various features have been provided in the context of various described embodiments, but may be used in other embodiments. The combinations of features described herein should not be interpreted to be limiting, and the features herein may be used in any working combination or sub-combination according to the invention. This description should therefore be interpreted as providing written support, under U. S. patent law and any relevant foreign patent laws, for any working combination or some sub-combination of the features herein.

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A gaming machine comprising:

a cabinet housing a display system, an audio device, a player input device, and at least one electronic controller operatively coupled to the player input device, the audio device, and the display and configured to execute instructions related to a game and to cause credits to be awarded to a player in response to wins;

a mechanical wheel mounted to the cabinet and including a selection indicator and a plurality of segments each having a prize amount and one of a plurality of wheel segment types, the mechanical wheel operable to spin and stop such that the selection indicator selects one of the segments;

tangible, non-transitory electronically accessible memory coupled to the at least one electronic controller and containing program code executable by the at least one electronic controller for:

operating the gaming machine to receive results for a primary game presented at the display system;

displaying a plurality of reels in each primary game including symbol locations which are updated with symbols to display the results, the reels comprising a plurality of wheel trigger symbols having a plurality of types each associated with a respective one of the wheel segment types, at least some wheel trigger symbols of each type including a multiplier value greater than one;

responsive to a result including a designated number of wheel trigger symbols in a designated winning pattern, triggering a spin of the mechanical wheel to select a segment; and responsive to the selected segment's type matching that of a selected wheel trigger symbol in the designated winning pattern, displaying a modification to a wheel spin paytable in a first display area of the display system applying the multiplier value of the selected wheel trigger symbol, and providing an award of the selected segment's prize amount times the selected wheel trigger symbol's multiplier value.

2. The gaming machine of claim 1, wherein the wheel segments types are associated with a majority color of the wheel segments.

3. The gaming machine of claim 1, wherein the multiplier values comprise a plurality of values greater than 1.

4. The gaming machine of claim 3, wherein the multiplier values further comprises a value of 1 or no multiplier, and wherein the program code is further executable, responsive to an outcome for which the selected wheel trigger symbol's multiplier value is 1 or no multiplier, cause the first display area not to be modified.

5. The gaming machine of claim 1, wherein each of the plurality of reels contains wheel trigger symbols of only one of the types.

6. The gaming machine of claim 1, wherein the designated pattern includes a combination of wheel trigger symbols on each of the reels.

7. The gaming machine of claim 1, wherein the program code is further executable by the at least one electronic controller to, responsive to the selected segment's type matching that of a selected wheel trigger symbol in the designated winning pattern, displaying a modification to an active display area on the wheel.

8. A method a method of operating a gaming machine including a display system, a input device, a mechanical wheel, and at least one electronic controller operatively coupled to the input device, the display system and the mechanical wheel and configured to execute instructions for providing a game, the method comprising:

operating the gaming machine to receive a and obtain results for a primary game presented at the display system;

displaying a plurality of reels in each primary game including symbol locations which are updated with symbols to display the results, the reels comprising a plurality of wheel trigger symbols having a plurality of types, at least some wheel trigger symbols of each type including a multiplier value greater than one;

responsive to a result including a designated number of wheel trigger symbols in a designated winning pattern, triggering a spin of the mechanical wheel to select a segment having a prize amount and a one of a plurality of wheel segment types each associated with a respective one of the wheel trigger symbol types; and responsive to the selected segment's type matching that of a selected wheel trigger symbol in the designated winning pattern, displaying a modification to a wheel spin paytable in a first display area of the display system applying the multiplier value of the selected wheel trigger symbol, and providing an award of the selected segment's prize amount times the selected wheel trigger symbol's multiplier value.

9. The method of claim 8, wherein the wheel segment types are associated with a majority color of the wheel segments.

10. The method of claim 8, wherein the multiplier values comprise a plurality of values greater than 1.

11. The method of claim 10, wherein the multiplier values further comprises a value of 1 or no multiplier, and further comprising, responsive to an outcome for which the selected wheel trigger symbol's multiplier value is 1 or no multiplier, causing the first display area not to be modified.

12. The method of claim 8, wherein each of the plurality of reels contains wheel trigger symbols of only one of the types.

13. The method of claim 8, wherein the designated pattern includes a combination of wheel trigger symbols on each of the reels.

14. The method of claim 8, further comprising, responsive to the selected segment's type matching that of a selected wheel trigger symbol in the designated winning pattern, displaying a modification to an active display area on the wheel.

15. A tangible, non-transitory computer readable medium holding a program product for execution by a controller of a gaming machine having one or more video displays, the program product including machine instructions for:

operating the gaming machine to receive a and obtain results for a primary game presented at the display system;

displaying a plurality of reels in each primary game including symbol locations which are updated with symbols to display the results, the reels comprising a plurality of wheel trigger symbols having a plurality of types, at least some wheel trigger symbols of each type including a multiplier value greater than one;

responsive to a result including a designated number of wheel trigger symbols in a designated winning pattern, triggering a spin of a mechanical wheel to select a segment having prize amount and a one of a plurality of wheel segment types each associated with a respective one of the wheel trigger symbol types; and responsive to the selected segment's type matching that of a selected wheel trigger symbol in the designated winning pattern, displaying a modification to a wheel spin paytable in a first display area of the display system applying the multiplier value of the selected wheel trigger symbol, and providing an award of the selected segment's prize amount times the selected wheel trigger symbol's multiplier value.

16. The computer readable medium holding a program product of claim 15, wherein the wheel segment types are associated with a majority color of the wheel segments.

17. The computer readable medium holding a program product of claim 15, wherein the multiplier values comprise a plurality of values greater than 1.

18. The computer readable medium holding a program product of claim 15, wherein the multiplier values further comprises a value of 1 or no multiplier, and wherein the machine instructions are further executable, responsive to an outcome for which the selected wheel trigger symbol's multiplier value is 1 or no multiplier, cause the first display area not to be modified.

19. The computer readable medium holding a program product of claim 15, wherein each of the plurality of reels contains wheel trigger symbols of only one of the types.

20. The computer readable medium holding a program product of claim 15, wherein the designated pattern includes a combination of wheel trigger symbols on each of the reels.

* * * * *